US006904252B2

(12) United States Patent
Thornton et al.

(10) Patent No.: US 6,904,252 B2
(45) Date of Patent: Jun. 7, 2005

(54) IMAGE-BEARING ARTICLE CONTAINING CROSS-LINKED ELASTOMERS FOR ELECTROSTATIC PRINTING

(75) Inventors: Constance J. Thornton, Ontario, NY (US); Joseph Mammino, Penfield, NY (US); Robert M. Ferguson, Penfield, NY (US); Paul J. Brach, Rochester, NY (US); Edward Scales, Fairport, NY (US); Raymond K. Crandall, Rochester, NY (US); Edward L. Schlueter, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 177 days.

(21) Appl. No.: 10/249,253

(22) Filed: Mar. 26, 2003

(65) Prior Publication Data

US 2004/0190941 A1 Sep. 30, 2004

(51) Int. Cl.[7] ..... G03G 15/10

(52) U.S. Cl. ..... 399/159; 399/161; 399/237; 430/117; 430/66

(58) Field of Search ..... 399/159, 161, 399/237; 430/117, 66

(56) References Cited

U.S. PATENT DOCUMENTS 6,052,550 A * 4/2000 Thornton et al. ..... 399/237

* cited by examiner

*Primary Examiner*—Mark A. Chapman
(74) *Attorney, Agent, or Firm*—Oliff & Berridge, PLC

(57) ABSTRACT

An image-bearing article used in liquid contact electrostatic printing (CEP) is formed from polymers that meet the requisite conformance and heat stability for the CEP process. Excessive absorption of toner carrier liquids by the image-bearing article in liquid CEP leads to the deterioration of the image-bearing article and reduces the useful life of the image-bearing article. The absorption of the toner carrier fluid may be controlled by the addition of oxides, silicone elastomers containing phenyl end groups, fluorosilicones or increasing the cross-linking density of the methyl silicones.

8 Claims, 6 Drawing Sheets

Effect of Aerosil on Isopar Absorption

IMAGE-BEARING ARTICLE CONTAINING CROSS-LINKED ELASTOMERS FOR ELECTROSTATIC PRINTING

BACKGROUND OF THE INVENTION

1. Field of Invention

This invention relates to image-bearing articles used in an electrostatographic printing machine, such as a printing machine that employs a contact electrostatic printing process. The image-bearing articles of the present invention comprise a substrate, a conformable layer, and an optional outer release layer. In embodiments, the conformable layer may comprise conductive particles dispersed or contained therein.

2. Description of Related Art

Generally, processes for electrostatographic copying and printing are initiated by uniformly charging and selectively discharging a charge receptive photoreceptor in accordance with an original input document or an imaging signal, generating an electrostatic latent image on the photoreceptor. This latent image is subsequently developed into a visible image by a process in which charged developing material or toner solids are deposited onto the surface of the latent photoreceptor, wherein charged toner solids or particles in the developing material adhere to image areas of the latent image.

The developing material typically comprises carrier granules having marking or toner particles adhering triboelectrically thereto, wherein the toner particles are electrostatically attracted from the carrier granules to the latent image areas to create a powder toner image on the photoreceptor. Alternatively, the developing material may comprise a liquid developing material comprising a carrier liquid having pigmented marking particles (or so-called toner solids) and charge director materials dispersed and/or dissolved therein (so-called liquid toner), wherein the liquid developing material is applied to the latent image bearing photoreceptor with the marking particles being attracted to the image areas of the latent image to form a developed liquid image.

Regardless of the type of developing material employed, the toner or marking particles of the developing material are uniformly charged and electrostatically attracted to the latent image to form a visible developed image corresponding to the latent image on the photoreceptor. The developed image is subsequently transferred, either directly or indirectly, from the photoreceptor to a copy substrate, such as paper or the like, to produce a "hard copy" output document. In a final step, the photoreceptor is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface. It will be understood that the instant invention applies to all various types of electrostatic printing systems and is not intended to be limited by the manner in which the image is formed on the photoreceptor or the nature of the photoreceptor itself.

As described hereinabove, the typical electrostatographic printing process includes uniformly charging the entire surface of the photoreceptor, image-wise exposing the entire surface, and physically transporting developing material including charged marking or toner particles into contact with the photoreceptor so as to selectively develop the latent image areas thereon in an image-wise configuration. Development of the latent image is usually accomplished by electrostatic attraction of charged toner or marking particles to the image areas of the latent image.

The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Numerous and various alternative methods of developing a latent image have been described in the art of electrophotographic printing and copying. Of particular interest with respect to the present invention is the concept of forming on a surface, a thin layer of liquid developing material having a high concentration of charged marking particles, with the layer being acted upon by image-wise forces, and being separated into image and background portions. For the purposes of the present description, the concept of latent image development via direct surface-to-surface transfer of a toner layer via image-wise forces will be identified generally as Contact Electrostatic Printing (CEP). Air Breakdown Charge and Development (ABCD), is one variant of CEP, wherein a thin layer of liquid developer material is recharged using an air breakdown charging device, into opposite charge polarities in the image and background areas, which are thereafter separated. Because of the relatively large fraction of toner mass traditionally left in the background areas, cleaning and reuse of such toner from the background areas ordinarily can detrimentally affect the efficiency of the overall printing system.

The following sample references are cited as exemplary background art for the present invention. For example, U.S. Pat. No. 4,504,138 discloses a method of forming a latent electrostatic image on a uniformly charged surface, and developing the latent electrostatic image by applying a thin viscous layer of electrically charged toner particles to the electrostatic latent image. The apparatus includes an applicator roller mounted for rotation in a container for toner suspension, an electrode arranged adjacent the circumferential surface of the roller to define an electrodeposition chamber therebetween, and electrical connections between the roller, the electrode and a voltage source to enable electrolytic separation of toner particles in the chamber, thus forming a thin highly viscous layer of concentrated toner particles on the roller.

U.S. Pat. No. 5,387,760 discloses a wet development apparatus for use in a recording machine to develop a toner image corresponding to an electrostatic latent image on a uniformly charged electrostatic latent image carrying member or carrier. The apparatus includes a development roller disposed in contact with or near the electrostatic latent image carrier and an application head for applying a uniform layer of wet developer material to the roller.

U.S. Pat. No. 5,436,706 discloses an imaging apparatus including a first member having a first uniformly charged surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selectively transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, uniformly applying a layer of charge having a second electrical potential onto the charge bearing surface, and image-wise dissipating charge from portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving photoreceptor to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

In each of the sample types of references, the photoreceptor is typically charged uniformly, meaning that the entire surface of the photoreceptor is charged. Subsequently, non-image or background areas, for example, are then discharged in order to prevent them from being developed with non-image developing toner, along with image areas. In each of these references, image quality and inefficiency of the method and apparatus are therefore concerns. Image quality for example is a concern because it may vary significantly due to numerous conditions affecting latent image formation as well as latent image development. In particular, charge levels, both in the latent image, as well as in the developing material, can affect image development. For example, when the charge on dry toner particles becomes significantly depleted, binding forces with the carrier also become depleted, causing an undesirable increase in image development, which, in turn, causes the development of the latent image to spread beyond the area defined thereby.

Inefficiency in an image forming method and apparatus is impacted significantly, for example, by the quantity or volume of non-development or unused charged toner material that is applied to the photoreceptor and moved through the development nip. Such non-development charged toner can undesirably affect charge levels of cooperating elements, and of course has to be removed or cleaned subsequently from the photoreceptor in order to ready the photoreceptor for recharging and reuse. Such cleaning or removal efforts involve inefficiencies in themselves, and it is of course time consuming and costly to recycle or dispose of such non-development or unused charged toner after it has been applied to the photoreceptor, and moved through the development nip.

Generally, printing methods and apparatus including the CEP process, are set forth in, for example, in U.S. Pat. Nos. 5,826,147; 5,937,243; 5,937,248; 5,966,570; 6,099,294; 6,052,550; 6,122,471 and 6,289,191. The disclosures of these references are hereby incorporated by reference in their entirety.

SUMMARY OF THE INVENTION

An important component in CEP processes and apparatus is the image-bearing article, which generally carries the developed image prior to transfer to the final image substrate, such as paper. At the same time, the image bearing article must maintain sufficient image retention properties that the developed image is retained on the image bearing article from transfer to the image bearing article until final transfer to the print substrate, and without destruction or degradation of the developed image. The image-bearing article must have sufficient release properties to adequately release the developed image to a print substrate, such as paper. The image-bearing article must also be conformable enough to transfer to rough print substrates.

Additionally, since transfix (i.e., combined transfer of the developed image to the print substrate with concurrent fixing of that transferred image to the print substrate) is desirable in some CEP processes and apparatus, the image-bearing article preferably is stable at temperatures of up to about 125° C. or more.

The conformable layer of the image-bearing article is generally formed using a polymer or polymeric substance that meets the requisite conformance and heat stability in CEP processes. In addition, the image-bearing article can also meet conductivity requirements when filled with certain fillers, for example, such as carbon black. It is believed that toner release is facilitated by the absorption of the tone carrier fluid by the silicone, which forms a weak boundary between the image-bearing article surface and the toner image.

However, it has been discovered that excessive absorption of the toner carrier fluid can weaken the silicone film and thus reduce the useful life of the image-bearing article. In addition, uncontrolled swelling of the image-bearing article may result, which can lead to changes in image registration and image conditioning. The uniformity of thickness of the image-bearing article, conformance and nip parameters may also be adversely affected.

A need thus continues to exist in the art for improved image bearing articles that exhibit desired carrier fluid absorption, but which do not exhibit excess carrier fluid absorption over time. The need further exists for image bearing articles that thereby have an increased lifetime, resulting in increased process and apparatus reliability and efficiency. The need also exists for the ability to provide image bearing articles wherein the carrier fluid absorption can be tailored to different process and apparatus needs without requiring a complete redesign of the article production materials and process. These and other needs are addressed by the present invention.

An image-bearing article generally comprises: (i) a substrate; and (ii) at least one conformable layer comprising a conductive or semiconductive polymer adhered upon the surface of the substrate. The conformable layer may be formed from a polymer that may be selected from compounds such as silicone rubbers, fluoropolymers, polyurethanes and nitrile rubbers, and may additionally comprise a filler selected from the group consisting of metal oxides, carbon black, polymeric particles, and mixtures thereof.

To reduce the absorption of hydrocarbon fluids by the conformable layer, several approaches may be taken. In one exemplary embodiment of the invention, increasing the cross-linking density of the polymers of the conformable layer has been shown to correlate to a reduction of absorption. Additional exemplary embodiments of the invention may also include silicone elastomers containing phenyl end groups, combining methylsilicone elastomer with a fluorosilicone and a fluoroelastomer, or the addition fillers such as oxides.

BRIEF DESCRIPTION OF THE DRAWINGS

Certain preferred embodiments of this invention will be described in detail, with reference to the following figures, in which.

DETAILED DESCRIPTION OF PREFERRED EMBODIMENTS

The present invention is directed to image-bearing article useful in an electrostatographic-printing machine, especially a machine using contact electrostatic printing processes, wherein the image-bearing article generally comprises a substrate and at least one conformable layer.

Figure 1:
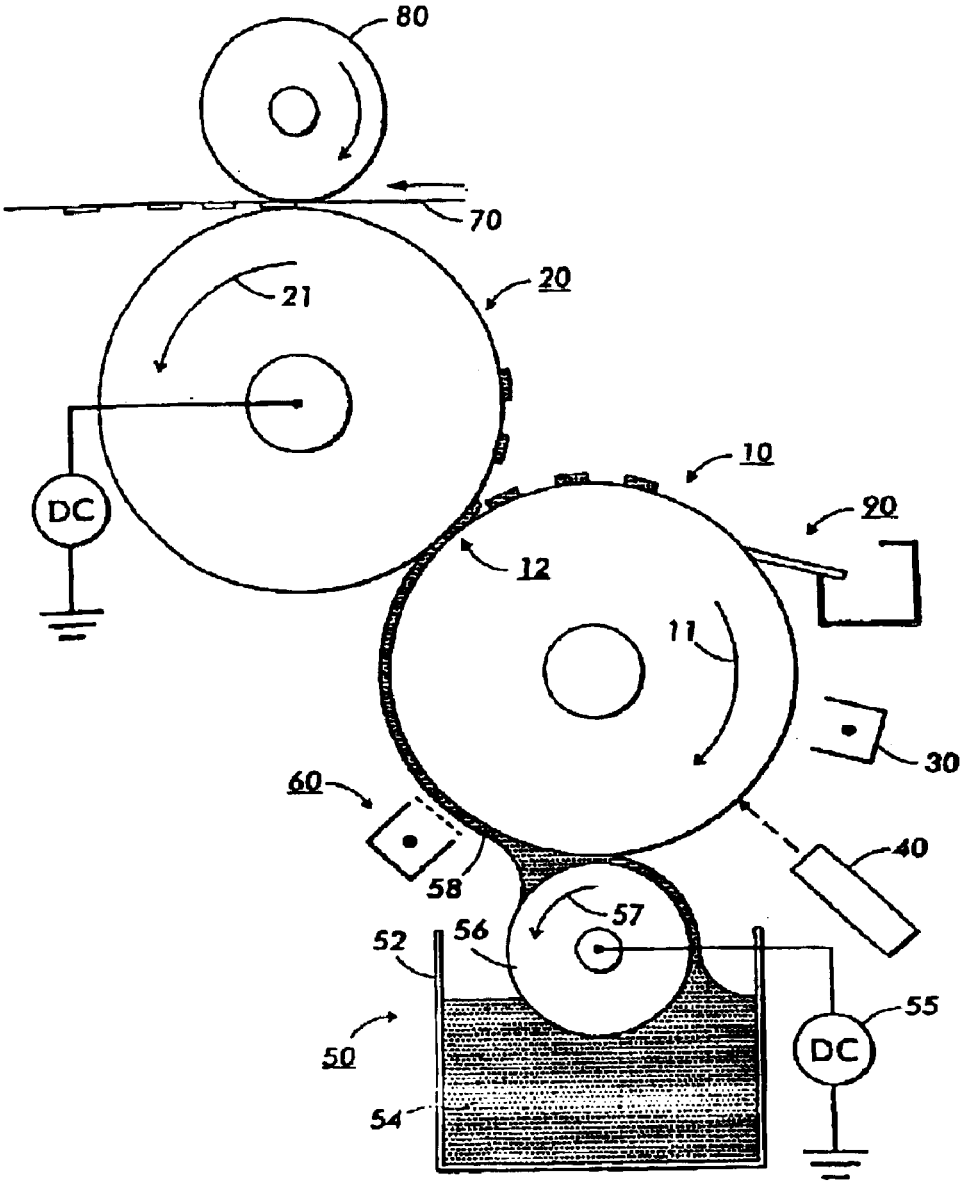
FIG. 1 is a schematic view of an embodiment of a contact electrostatic printing apparatus.

Reference is now made to the FIG. 1, which illustrates an imaging apparatus constructed and operative in accordance with one embodiment of the present invention. Shown in FIG. 1 is a first movable member in the form of an image-bearing article 10 including an imaging surface of any type capable of having an electrostatic latent image formed thereon image-bearing article 10 is rotated in the direction of arrow 11. In one embodiment, initially, the photoconductive surface of image-bearing article 10 passes through a charging station 30, which may include a corona generating device or any other charging apparatus for applying a substantially uniform electrostatic charge to the surface of the image-bearing article 10. Various charging devices, such as charge rollers, charge brushes and the like, as well as induction and semi-conductive charge devices, may be used for charging member 30.

In the embodiment shown in FIG. 1, the charged surface is advanced to image exposure station 40. The image exposure station projects a light image corresponding to the input image onto the charged image-bearing article surface. The light image projected onto the surface of the image-bearing article 10 selectively dissipates the charge thereon for recording an electrostatic latent image on the image-bearing article surface.

After the image-bearing article is exposed, a toner supply apparatus 50 cake formation member applies a very thin layer of marking or toner particles (and possibly a carrier such as a liquid solvent) onto the surface of the image-bearing article 10. FIG. 1 demonstrates an embodiment of a toner supply apparatus wherein housing 52 is adapted to accommodate a supply of toner particles 54 and any additional carrier material, if necessary. In this embodiment, the toner applicator 50 includes an applicator roller 56, which is rotated in direction 57, to transport toner from housing 52 into contact with the surface of the image-bearing article 10. In this manner, a substantially uniformly distributed layer of toner 58, or a so-called "toner cake," is formed thereon.

The toner cake can be created in various ways, depending on the materials used in the printing process, as well as other process parameters such as process speed and the like. Generally, a layer of toner particles having sufficient thickness (preferably from about 2 to about 15 microns, and more preferably from about 3 to about 8 microns), may be formed on the surface of the imaging member 10 by transferring an ink cake of similar thickness and solid content from the applicator member 56. In a preferred embodiment, electrical biasing 55 may be employed to assist in actively moving the toner cake from the applicator 56 onto the surface of the image-bearing article 10. In this embodiment, toner applicator 56 is provided with an electrical bias of magnitude greater than both the image and non-image (background) areas of the electrostatic latent image on the image-bearing article 10. These electrical fields cause toner particles to be transferred to image-bearing article 10 for forming a substantially uniform layer of toner particles on the surface thereof.

In the case of liquid developing materials, it is desirable that the toner cake formed on the surface of the image-bearing article 10 be comprised of at least about 10 percent by weight toner solids, and preferably in the range of from about 15 to about 35 percent by weight toner solids.

After toner layer 58 is formed on the surface of the image-bearing article 10, the toner layer is charged using charging device 60 (which, in embodiments, may be a scorotron device) in an image-wise manner. In embodiments, the charging device 60 introduces free mobile ions in the vicinity of the charged latent image to facilitate the formation of an image-wise ion stream extending from the source 60 to the latent image on the surface of the image-bearing article 10. The ion source 60 should provide ions having a charge opposite the original toner layer charge polarity. To achieve good image quality, the charge member 60 is preferably provided with an energizing bias at its grid intermediate the potential of the image and non-image areas of the latent image on the image-bearing article 10. The image-wise ion stream generates a secondary latent image in the toner layer made up of oppositely charged toner particles in image configuration corresponding to the original latent image.

Once the secondary latent image is formed in the toner layer, the image-wise charged toner layer is advanced to the image separator 20 which rotates in direction 21. The image separator 20 may be provided in the form of a biased roll member having a surface adjacent to the surface of the image-bearing article 10, and preferably contacting the toner layer 58 residing on image-bearing article 10. An electrical biasing source is coupled to the image separator 20. In embodiments as depicted in FIG. 1, the image separator 20 is biased with a polarity opposite the charge polarity of the image areas in the toner layer 58 for attracting image areas therefrom. The developed image is made up of selectively separated and transferred portions of the toner cake on the surface of the image separator 20. Background image byproduct is left on the surface of the image-bearing article 10. Alternatively, the image separator 20 can be provided with an electrical bias having a polarity appropriate for attracting non-image areas away from the image-bearing article 10. The toner portions corresponding to image areas on the surface of the imaging member can be maintained yielding a developed image thereon.

After the developed image is created, the developed image then may be transferred to a copy substrate 70 via image separator 20 together with a heated member 80 or a non-heated pressure member. The background image byproduct on either the image-bearing article 10 is subsequently removed from the surface in order to clean the surface in preparation for a subsequent imaging cycle. FIG. 1 illustrates a blade cleaning apparatus 90. In the embodiment shown in FIG. 1, the removed toner is transported to a toner sump or other reclaim vessel so that the waste toner can be recycled and used again.

The process of generating a secondary latent image in the toner cake layer will be described in greater detail with respect to FIG. 2, where the initially charged toner cake 58 is illustrated, for purposes of simplicity only, as a uniformly distributed layer of negatively charged toner particles having the thickness of a single toner particle. The toner cake resides on the surface of the image-bearing article 10, which is being transported from left to right past the broad source ion-charging device 60. As previously described, the primary function of the broad source ion charging device 60 is to provide free mobile ions in the vicinity of the image bearing article 10 having the toner layer and latent image thereon. As such, the broad source ion device may be embodied as various known devices, including, but not limited to, any of the variously known corona generating devices available in the art, as well as charging roll type devices, solid state charge devices and electron or ion sources analogous to the type commonly associated with ionographic writing processes.

Figure 2:
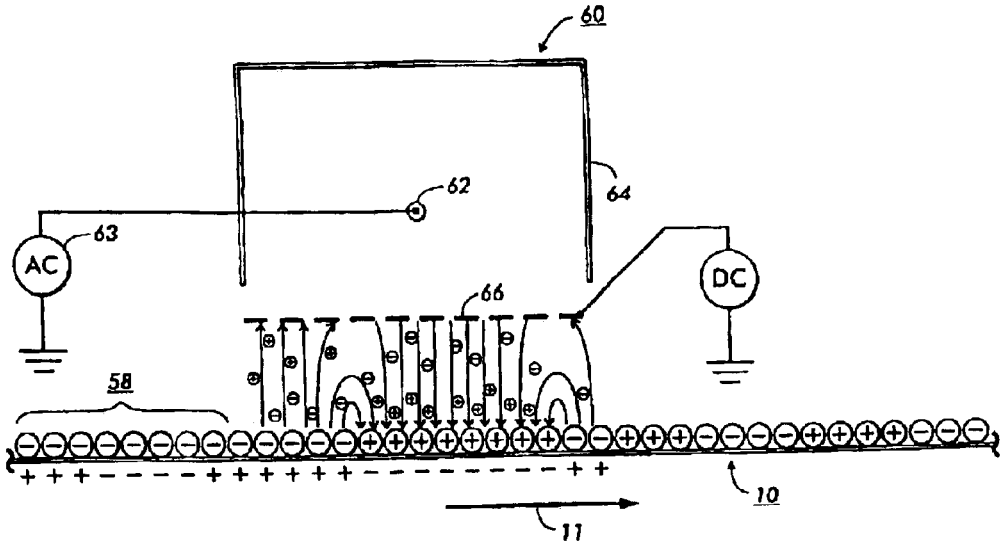
FIG. 2 is an exploded view illustrating image-wise charging of a toner layer by a broad source ion-charging device.

In the particular embodiment shown in FIG. 2, a scorotron type corona-generating device is used. The scorotron device comprises a corona-generating electrode 62 enclosed within a shield member 64 surrounding the electrode 62 on three sides. A wire grid 66 covers the open side of the shield member 64 facing the imaging member 10. In operation, the corona-generating electrode 62, otherwise known as a coronode, is coupled to an electrical biasing source 63 capable of providing a relatively high voltage potential to the coronode, which causes electrostatic fields to develop between the coronode 62 and the grid and the image-bearing article 10. The force of these fields causes the air immediately surrounding the coronode to become ionized, generating free mobile ions that are repelled from the coronode toward the grid 66 and the image-bearing article 10. As is well known to one of skill in the art, the scorotron grid 66 is biased so as to be operative to control the amount of charge and the charge uniformity applied to the imaging surface 10 by controlling the flow of ions through the electrical field formed between the grid and the imaging surface.

Alternative embodiments for charging the image-bearing article and creating a secondary latent image may be employed. For example, such alternative embodiments include, but are not limited to, using a biased roll member or charging device. These are two preferred exemplary embodiments. It should be appreciated that the image-bearing article of the present application can be used with other contact electrostatic printing apparatuses that employ dry or liquid toner cake or toner compositions as the developer material.

Thus, the image-bearing article may be charged and a secondary latent image created by replacing the ion source 60 shown in FIG. 1 with a biased roll member and an electrical biasing source. The subject matter of this embodiment is described in detail in U.S. Pat. No. 5,937,243, the disclosure of which is hereby incorporated in its entirety.

Alternatively, the charging member 30 and an image exposure station 40 may be replaced by a charging device. An exemplary charging device may be, for example, a scorotron device. The charging device introduces free mobile ions in the vicinity of the charged latent image, to facilitate the formation of an image-wise ion stream extending from the charging device to the latent image on the surface of the image-bearing article 10. The disclosure of this embodiment is described in detail in U.S. Pat. No. 5,966,570, the disclosure of which is incorporated herein by reference in its entirety.

Figure 3:
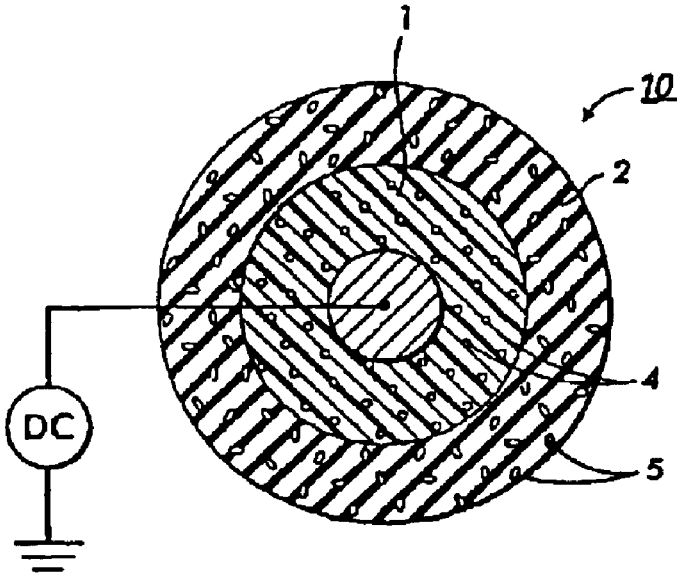
FIG. 3 is a cross sectional view of an embodiment of an image-bearing article demonstrating a two layer configuration.

FIG. 3 demonstrates an embodiment of the image-bearing article. The image-bearing article 10 in FIG. 3 comprises substrate 1 and conformable layer 2. In addition, FIG. 3 demonstrates a preferred embodiment of the invention wherein substrate 1 comprises conductive filler 4, and wherein conformable layer 2 comprises conductive filler 5. Conductive fillers 4 and 5 may be the same or different.

Figure 4:
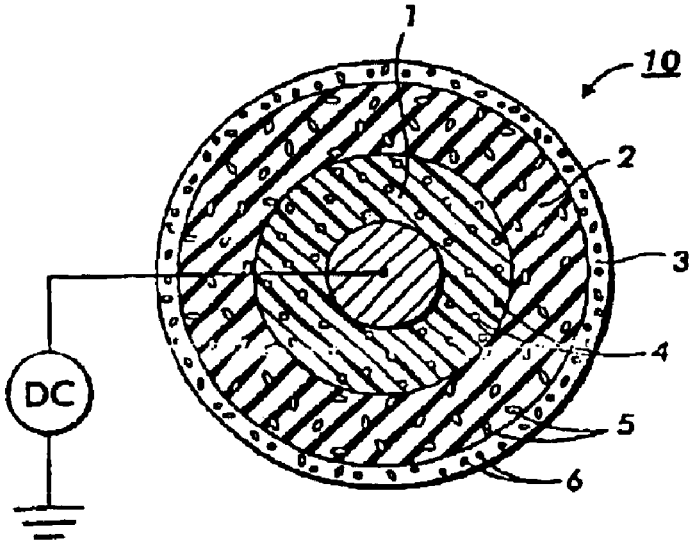
FIG. 4 is a cross sectional view of an embodiment of an image-bearing article demonstrating a three layer configuration.

FIG. 4 demonstrates another embodiment of the image-bearing article, wherein image-bearing article 10 comprises substrate 1, conformable layer 2 and outer release layer 3. Also depicted in FIG. 4 are conductive fillers in each layer, wherein substrate 1 comprises conductive filler 4, conformable layer 2 comprises conductive filler 5, and outer release layer 3 comprises conductive filler 6. Conductive fillers 4, 5, and 6 may be the same or different.

The image-bearing article also may be of various configurations. These configurations generally include at least one conformable layer positioned on a substrate, wherein the substrate may be a belt, sheet, film, roller or the like. Another suitable configuration is at least one conformable layer positioned on a substrate, and an outer release layer positioned on the conformable layer. Again, the substrate may be in the form of a belt, sheet, film, roller or the like. The conformable layer(s) may comprise a conformable conductive material, a conformable semiconductive material, or a combination of both. The outer release layer is preferably a thin insulating release layer, but can be any other suitable layer Any number of conformable layers may be present, although it is preferred that this is 1, 2, 3, 4 or 5 conformable layers. In another configuration, an insulating layer may be positioned on the conformable layer (s). In addition, there may be a suitable adhesive positioned between the conformable layer and the substrate, and/or positioned between the conformable layer and the outer release layer or thin insulating layer and/or between multiple conformable layers. In the belt or sheet or film substrate configuration, the belt may be seamed or seamless.

In the configuration wherein the substrate is a belt, sheet, film or the like, preferred examples of suitable substrate materials include, but are not limited to, polyimides and polyamides such as PAI (polyamideimide), PI (polyimide), polyaramide, polyphthalamide, fluorinated polyimides, polyimidesulfone, polyimide ether, and the like. Specific examples are set forth, for example, in U.S. Pat. No. 5,037,587, the disclosure of which is herein incorporated by reference in its entirety. Other suitable materials for the substrate belt include, but are not limited to, polyester such as polyethylene naphthate; polyethylene terephthalate (PET); polysulfone; polycarbonate; polyphenylene sulfide; polyketone; polyether ether ketone (PEEK); polyethersulfone (PES); polyaryletherketone (PAEK); polyparabanic acid (PBA); and the like. As desired, the substrate can comprise one of the aforementioned materials, or can comprise combinations of two or more.

In another embodiment, the substrate may comprise a fabric material such as woven or nonwoven fabric, knitted or felted fabric, or any other suitable fabric using natural or synthetic fibers. Fabric, as used herein, refers to a textile structure comprised of mechanically interlocked fibers or filaments, which may be woven or nonwoven. Fabrics are materials made from fibers or threads and woven, knitted or pressed into a cloth or felt type structure. Woven, as used herein, refers to closely oriented by warp and filler strands at right angles to each other. Nonwoven, as used herein, refers to randomly integrated fibers or filaments. Examples of suitable fabrics include, but are not limited to, woven or nonwoven cotton fabric, graphite fabric, fiberglass, woven or nonwoven polyimide (for example KEVLAR® available from DuPont), woven or nonwoven polyamide, such as nylon or polyphenylene isophthalamide (for example, NOMEX® of E. I. DuPont of Wilmington, Del.), polyester, polycarbonate, polyacryl, polystyrene, polyethylene, polypropylene, cellulose, polysulfone, polyxylene, polyacetal, mixtures thereof and the like. Further details of such fibers useful as substrates are set forth, for example, in U.S. Pat. No. 5,999,787, the disclosure of which is hereby incorporated by reference in its entirety.

The polymer used as the substrate in the belt configuration may be filled or unfilled. Examples of preferred fillers include, but are not limited to, carbon black fillers, metal oxides, and polymer particles. Specific examples of fillers include, but are not limited to, carbon black, fluorinated carbon black, graphite, and the like, and mixtures thereof; metal oxides such as indium tin oxide, zinc oxide, iron oxide, aluminum oxide, copper oxide, lead oxide, and the like, and mixtures thereof; doped metal oxides such as antimony doped tin oxide, antimony doped titanium dioxide, aluminum doped zinc oxide, similar doped metal oxides, and mixtures thereof; and polymer particles such as polypyrrole, polyaniline, and the like, and mixtures thereof. Preferably, the filler, if present in the substrate, is present in an amount of from about 1 to about 40, and preferably from about 2 to about 30 percent by weight of total solids. Preferably, the belt substrate has a resistivity range of from about $10^3$ to about $10^{13}$ Ω-cm, and preferably from about $10^6$ to about $10^9$ Ω-cm.

It is preferable in embodiments that the substrate be an endless, seamed flexible belt and seamed flexible belts, which may or may not include puzzle cut seams. Examples of such belts are described, for example, in U.S. Pat. Nos. 5,487,707; 5,514,436; and U.S. patent application Ser. No. 08/297,203, the disclosures of each of which are incorporated herein by reference in their entirety. A method for manufacturing reinforced seamless belts is set forth, for example, in U.S. Pat. No. 5,409,557, the disclosure of which is hereby incorporated by reference in its entirety.

In the configuration wherein the substrate is in the form of a roller, the substrate may comprise a tough, resistant plastic material such as any of the materials listed above for the belt configuration. Alternately, the roller may comprise a metal such as aluminum, nickel, stainless steel, or the like. In another embodiment, the roller may comprise a fabric as set forth above.

The conformable layer or layers generally has a low modulus. Molding of the toner into the surface of the porous or rough paper (or other print substrate) facilitates complete transfer. Transfer from non-conforming materials to rough substrates is limited to the contact points (high spots of the paper surface) and results in poor image quality. The release layer provides surface qualities such that the toner image is moved through the process undisturbed but is easily transferred to paper. Toner sticks to poorly releasing materials resulting in degraded image quality and excessive need for cleaning the image separator. Therefore, a release layer facilitates improved toner transfer.

The conformable layer or layers is preferably conformable enough to transfer the toner image to rough papers. Preferably, the conformable layer has a thickness of from about 0.001 to about 0.5 inches, and preferably from about 0.003 to about 0.150 inches. Preferably, the conformable layer has a hardness of from about 30 to about 70 Shore A units, preferably about 50 to about 60 Shore A units. The conformable layer of the image-bearing article comprises silicone elastomers. Typically, suitable silicone elastomers include methyl silicones; room temperature vulcanization (RTV) silicone rubbers; high temperature vulcanization (HTV) silicone rubbers and low temperature vulcanization (LTV) silicone rubbers. Specific examples of suitable silicone rubbers include Rhodorsil® from Rhone Poulenc (with crosslinking agent Silbond® 40 (ethyl silicate), curing agent Fascat® 4200 (dibutyl tin diacetate)).

The cross-link density in the conformable layer of the image-bearing article may be adjusted, if desired, by increasing the concentration of suitable cross-linking agents, such as Silbond® 40 (ethyl silicate). The extent to which cross-linking should be increased may depend on factors such as the operation temperatures to which the image-bearing article is subjected. Higher operational temperatures would generally require greater degrees of crosslinking due to the temperature dependence of the carrier diffusion rate. The addition of supplemental fillers or the preparation of the conformable layer with phenylsilicones or fluorosilicone elastomers with a fluoroelastomer, as described below, may also be used in conjunction with increasing the crosslinking density of the conformable layer.

Silicone elastomers containing phenyl end groups may also be used in or added to the materials of the conformable layer. Silicone elastomeric polymers containing phenyl groups, as well as fluorosilicone elastomeric polymers, are known to absorb less liquid toner carrier fluid than methyl silicone elastomeric polymers. Mixtures of compatible methyl, phenyl- and fluoro-silicones such that the necessary level of carrier absorption facilitates image transfer is achieved, but excess carrier absorption is avoided, can be formulated. The properties of such a blended silicon image-bearing article may also be improved by adding various fillers to the composition to modify the electrical, magnetic and mechanical properties of the image-bearing article. Suitable fillers are described in greater detail below.

The conformable layer may, in addition, comprise a conductive or semiconductive material. In order to improve the resistance to absorption of toner carrier liquids, the conformable layer can be made of suitable conformable materials such as fluoropolymers, including TEFLON® and TEFLON®-like materials and fluoroelastomers; silicone materials such as silicone rubbers, siloxanes, polydimethylsiloxanes and fluorosilicones; aliphatic or aromatic hydrocarbons; polyurethanes; nitrile rubbers; copolymers or terpolymers of the above, and the like; and mixtures of these. These materials may also be mixed with the more typical methyl silicones as well. The conductive or semiconductive material is present in an amount of about 30 to about 99.5, and preferably from about 60 to about 90 percent by weight of total solids.

Where multiple conformable layers are present, the multiple layers may be the same or different.

Particularly useful fluoropolymer conformable layers for the present invention include TEFLON®-like materials such as polytetrafluoroethylene (PTFE), fluorinated ethylenepropylene copolymer (FEP), perfluorovinylalkylethertetrafluoroethylene copolymer (PFA TEFLON®), copolymers thereof, and the like.

Examples also include elastomers such as fluoroelastomers. Specifically, suitable fluoroelastomers are those described in detail in U.S. Pat. Nos. 5,166,031; 5,281,506; 5,366,772; 5,370,931; 4,257,699; 5,017,432; and 5,061,965, the disclosures each of which are incorporated by reference herein in their entirety. These fluoroelastomers, particularly from the class of copolymers, terpolymers, and tetrapolymers of vinylidenefluoride, hexafluoropropylene and tetrafluoroethylene and a possible cure site monomer, are known commercially under various designations as VITON A®, VITON E®, VITON E60C®, VITON E430®, VITON 910®, VITON GH® VITON GF®, VITON E45®, VITON A201C®, and VITON B50®. The VITON® designation is a Trademark of E. I. DuPont de Nemours, Inc. Other commercially available materials include FLUOREL 2170®, FLUOREL 2174®, FLUOREL 2176®FLUOREL 2177®, FLUOREL 2123®, and FLUOREL LVS 76®, FLUOREL® being a Trademark of 3M Company. Additional commercially available materials include AFLAS™ a poly(propylene-tetrafluoroethylene) and FLUOREL II® (LII900) a poly(propylene-tetrafluoroethylenevinylidenefluoride) elastomer both also available from 3M Company. Also preferred are the TECNOFLONS® identified as FOR-60 KIR®, FOR-LHF®, NM® FOR-THF®, FOR-TFS®, TH®, and TN505®, available from Montedison Specialty Chemical Company.

In a preferred embodiment, the fluoroelastomer is one having a relatively low quantity of vinylidenefluoride, such as in VITON GF®, available from E. I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomer. The fluorine content of the VITON GF® is about 70 weight percent by total weight of fluoroelastomer.

Other suitable fluoroelastomers include the latex fluoroelastomers such as those available from Lauren International and Ausimont. Examples of latex fluoroelastomers are described, for example, in U.S. Pat. No. 6,103,815, the disclosure of which is hereby incorporated by reference in its entirety. These materials have the advantage of being aqueous dispersions, and therefore, are environmentally friendly.

Other suitable fluoroelastomers include fluoroelastomer composite materials which are hybrid polymers comprising at least two distinguishing polymer systems, blocks or monomer segments, wherein one monomer segment (hereinafter referred to as a "first monomer segment") of which possesses a high wear resistance and high toughness, and the other monomer segment (hereinafter referred to as a "second monomer segment") of which possesses low surface energy. The composite materials described herein are hybrid or copolymer compositions comprising substantially uniform, integral, interpenetrating networks of a first monomer segment and a second monomer segment, and in some embodiments, optionally a third grafted segment, wherein both the structure and the composition of the segment networks are substantially uniform when viewed through different slices of the separator member layer. Interpenetrating network, in embodiments, refers to the addition polymerization matrix where the polymer strands of the first monomer segment and second monomer segment, and optional third grafted segment, are intertwined in one another. A copolymer composition, in embodiments, is comprised of a first monomer segment and second monomer segment, and an optional third grafted segment, wherein the monomer segments are randomly arranged into a long chain molecule.

Examples of polymers suitable for use as the first monomer segment or tough monomer segment include, for example polyamides, polyimides, polysulfones, and fluoroelastomers. Examples of the low surface energy monomer segments or second monomer segment polymers include polyorganosiloxanes, and include intermediates which form inorganic networks. An intermediate is a precursor to inorganic oxide networks present in polymers described herein. This precursor goes through hydrolysis and condensation followed by the addition reactions to form desired network configurations of, for example, networks of metal oxides such as titanium oxide, silicon oxide, zirconium oxide and the like; networks of metal halides; and networks of metal hydroxides. Examples of intermediates include metal alkoxides, metal halides, metal hydroxides, and a polyorganosiloxane as defined above. The preferred intermediates are alkoxides, and specifically preferred are tetraethoxy orthosilicate for silicon oxide network and titanium isobutoxide for titanium oxide network. In embodiments, a third low surface energy monomer segment is a grafted monomer segment and, in preferred embodiments, is a polyorganosiloxane as described above. In these preferred embodiments, it is particularly preferred that the second monomer segment is an intermediate to a network of metal oxide. Preferred intermediates include tetraethoxy orthosilicate for silicon oxide network and titanium isobutoxide for titanium oxide network.

Examples of suitable polymer composites include volume grafted elastomers, titamers, grafted titamers, ceramers, grafted ceramers, polyamide polyorganosiioxane copolymers, polyimide polyorganosiloxane copolymers, polyester polyorganosiloxane copolymers, polysulfone polyorganosiloxane copolymers, and the like. Titamers and grafted titamers are disclosed in U.S. Pat. No. 5,456,987; ceramers and grafted ceramers are disclosed in U.S. Pat. No. 5,337,129; and volume grafted fluoroelastomers are disclosed in U.S. Pat. No. 5,366,772. In addition, these fluoroelastomer composite materials are disclosed in U.S. Pat. No. 5,778,290. The disclosures of these patents are hereby incorporated by reference in their entirety.

Other suitable conformable materials for the conformable layer include polyurethanes such as BAYHYDROL® 121 (Bayer), nitrile rubbers, and the like.

The conformable layer may be filled or unfilled with a suitable conductive filler. Preferred conductive fillers for addition to the conformable material include carbon black, metal oxides, and polymer particles. Preferably, the fillers include carbon black such as Black Pearls® 2000, fluorinated carbon such as those sold under the tradename ACCUFLUOR, graphite, and the like, and mixtures thereof; metal oxides such as indium tin oxide, zinc oxide, iron oxide, aluminum oxide, ferric oxide, ferrous oxide, copper oxide, lead oxide, and the like, and mixtures thereof; doped metal oxides such as antimony doped tin oxide, antimony doped titanium dioxide, aluminum doped zinc oxide, similar doped metal oxides, and mixtures thereof; and polymer particles such as polypyrrole, polyaniline, and the like, and mixtures thereof. The conductive filler, if present in the conformable layer, is preferably present in an amount of from about 2 to about 40%, and preferably from about 5 to about 12% by weight of total solids. These ranges depend on the dispersion quality and the conductivity of the filler.

The addition of certain fillers can also control the absorption of liquid toner carrier fluid by the image-bearing article. The type and concentration can be varied to control the absorption of the carrier fluid. Effective fillers include various oxides including, but not limited to, those of silicon, aluminum, zinc, titanium, tine antimony, indium, barium, iron, nickel chromium, copper, magnesium and the like, which can be used alone or in mixtures. The various oxides may additionally be treated with various functionalized silanes, titanates, zirconates and the like to improve adhesion with the silicone elastomer matrix. The amount and type of filler may also be used to regulate the electrical and/or magnetic properties of the image-bearing article. For example, chromium, nickel, and iron oxides may be magnetic and could be useful to manipulate certain toners for improved transfer or cleaning in special xerographic systems. In addition, barium and titanium oxides may be used to increase the dielectric constant of the composite layer. The filler may also be used to enhance tensile, durometer and other physical properties of the image-bearing article. In certain applications, the balance of fillers may also be selected to regulate the amount of liquid absorption into the silicone matrix and thus allow the image-bearing article to function as an image-conditioning surface.

There may be present on the conformable layer, or on the outer conformable layer when more than one conformable layer is present, an outer release layer. The outer release layer may comprise a polymer such as a fluoropolymer or a silicone rubber. Examples of suitable fluoropolymers include TEFLON®-like materials, fluoroelastomers such as those listed herein, other low surface energy polymers and elastomers. Preferred are TEFLON®-like materials, and materials such as silicone which absorb some of the liquid toner carrier fluid and thus form a weak boundary. The outer release layer may or may not comprise fillers. If there is a filler present, the filler is present in the same amounts as set forth above for the conformable layer. However, the filler concentration may be varied in this layer, depending on the polymer and the specific filler material used. Examples of suitable fillers include those listed above for the conformable layer. The outer release layer may comprise the same material as the conformable layer. The outer layer is thin, having a thickness of a monolayer or having a thickness of from about 0.01 to about 0.1 inches, preferably from about 0.02 to about 0.05 inches.

Suitable adhesives may be present between the substrate and the conformable layer, and/or between the conformable layer and the optional outer release layer. The choice of adhesive will depend on the composition of the layer or layers intended to be bonded.

A particularly preferred image-bearing article comprises a polyimide substrate, an adhesive, and a silicone conformable layer with carbon black conductive filler and no outer release layer. Another preferred embodiment comprises a polyimide substrate, adhesive, a fluoroelastomer (such as VITON® GF) conformable layer with carbon black filler, adhesive, and an outer silicone outer release layer.

The image-bearing article may be made by known processes including applying the conformable layer and/or release layers by spray coating, flow coating, slot draw down, and like known or after-developed methods.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLES

Example 1

Preparation of Image-bearing Article Conformable Layer

A conformable layer for an image-bearing article used in a contact electrostatic printing apparatus, such as one of the apparatuses described herein, is prepared as follows. An adhesive (Dow Corning A4040 primer) is first spray coated onto a 3 mil thick conductive polyimide substrate. A conformable layer coating is then prepared by mixing silicone rubber (Rhodorsil from Rhone Poulenc) in an amount of about 65 percent by weight of total solids with 6 percent by weight of total solids of carbon black (Black Pearls 2000). An ethyl silicate crosslinking agent (Silbond 40) is added using the concentration recommended by the manufacturer (15 pph).

Carbon black is dispersed in the mixture by roll milling the mixture in a ceramic jar with 3,000 g of half-inch ceramic shots for about 48 hours. The dispersion is then filtered. Subsequently, about 0.20 percent by weight of total solids of dibutyl tin diacetate curing agent (Fascat 4200) is added by stirring. The solution is then applied to the polyimide substrate with the adhesive thereon by spray coating, slot draw down or flow coating processes. The coating is air dried for 15 minutes, and cured by step heat curing at temperatures ranging from about 90 to about 450° F. for about 12 hours. The resulting conformable coating is about 0.003" thick.

The image-bearing article prepared is subjected to testing in a prototype contact electrostatic printing apparatus. Excellent sharp images with no background are obtained with the resulting image-bearing article. Transfer efficiency is demonstrated at 100 percent, and the resulting copy quality is high with the desired high level of gloss. Testing consists of coating sequential, very thin, layers of Isopar M into a Teflon sheet and exposing the image-bearing article samples to the Isopar layer. Flex life is found to be 300,000 cycles and breadboard cycling is in excess of 1,000 cycles.

Example 2

Image-bearing Article Containing Crosslinked Silicone Elastomers

Figure 5:
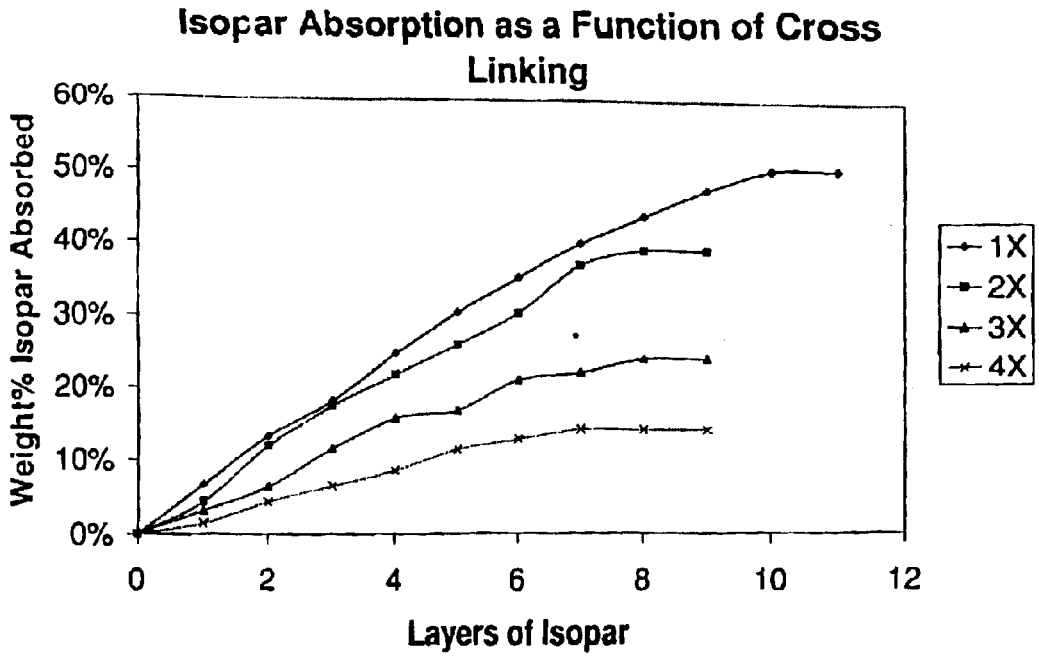
FIG. 5 is a graph showing the effect of increasing cross-linking density of the conforming layer on Isopar absorption.

Image bearing article materials according to this Example are prepared as described in Example 1. However, mixtures having 30, 45 and 60 parts per hundred (pph) of the crosslinking agent are prepared. Reduced weight percentage of absorbed Isopar is observed with increasing crosslinker concentration (see FIG. 5).

Failure in the presence of carrier fluid occurs in a sample of image-bearing article material at standard crosslinking density after 300,000 flex cycles. In contrast, an image-bearing article material in which 60 pph of the crosslinking agent is used demonstrates a five-fold increase in flex life, failing after 1,500,000 cycles.

Example 3

Image-bearing Article Containing Methylsilicone/fluorosilicone Elastomer and Fluoroelastomer Mix Image bearing article materials according to this Example are prepared as described in Example 1. However, proportions of methylsilicone to fluorosilicone to Viton are 3:4:16 in this Example.

| Conformable Layer (3 mil thick) | |
|---|---|
| Base elastomer | Rhodorsil (48V-3500) |
| Crosslinking agent | ethyl silicate |
| Curing agent | dibutyl tin diacetate |
| Conductive filler | carbon black (4% by weight) |
| Fluoroelastomer | Viton B50 with DIAK #3 |
| Fluorosilicone | HULS PS-181 |
| Adhesive | Dow Corning A4040 primer |
| Substrate | Conductive polyimide |

Comparative Example 1

An image-bearing article is prepared according to Example 3, with the exception that a conductive filler is not added. An image-bearing article having a similar mixture of components has been previously used by Delphax to produce a dielectric charge receiver for the CiPress ionographic printer. The CiPress charge receiver material completely released liquid toner image transfused to paper. As such, the release of the liquid toner in this manner suggests that an image-bearing article lacking any conductive filler would not be suitable.

Example 4

Image-bearing Article Containing Filler

Image bearing article materials according to this Example are prepared as described in Example 1. However, dispersions are prepared based on the above formulation with and without 1 wt % Aerosil 130(sold by DeGussa Corp.) added.

| Conformable Layer (3 mil thick) | |
|---|---|
| Base elastomer | Rhodorsil (48V-3500) |
| Crosslinking agent | ethyl silicate |
| Curing agent | dibutyl tin diacetate |
| Conductive filler | carbon black (4% by weight) |
| Strength filler | Aerosil 130 (none or 1% by weight) |
| Adhesive | Dow Corning A4040 primer |
| Substrate | Conductive polyimide |

Figure 6:
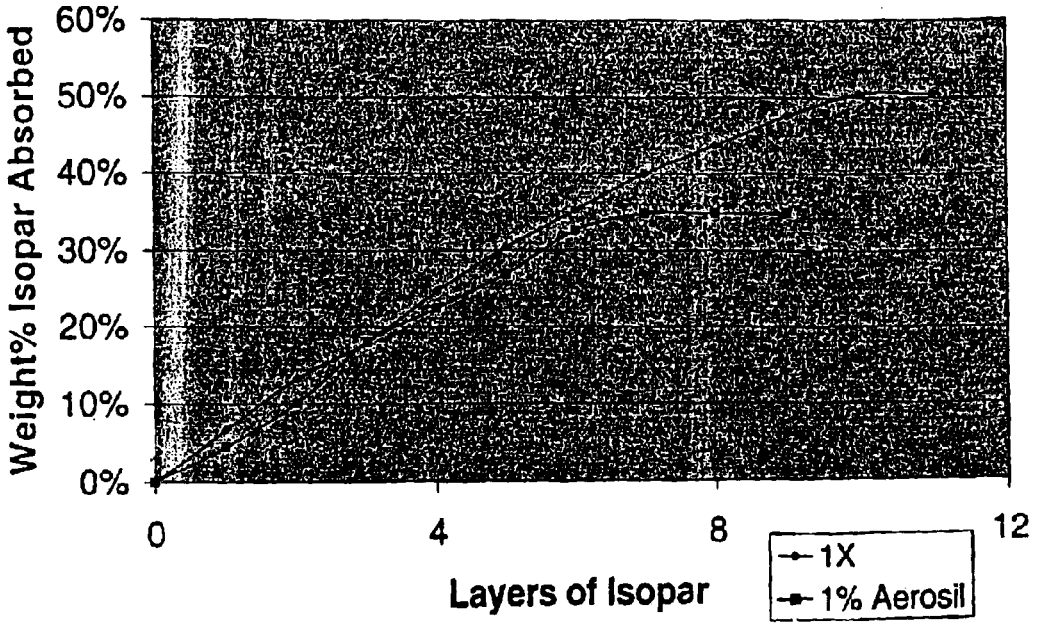
FIG. 6 is a graph showing the effect of Aerosil on Isopar absorption.

The accompanying FIG. 6 shows a reduction in weight % absorbed Isopar for those coatings containing the Aerosil filler. Image-bearing article layer thickness increase is also reduced because of the filler. Tensile strengths of the samples are measured. Strength improves from 198 psi for the control to 301 psi for the Aerosil additive case.

While the invention has been described in conjunction with the exemplary embodiments outlined above, it is evident that many alternatives, modifications and variations will be apparent to those skilled in the art. As explained above, although the resistance to absorption of hydrocarbon fluids is enhanced in the exemplary embodiments of the invention, the invention can be changed by modifying or combining the additives to reduce the absorption of carrier fluid. Accordingly, the exemplary embodiments of the invention as set forth above are intended to be illustrative, not limiting. Various changes may be made without departing from the spirit and scope of the invention as defined in the following claims.

What is claimed is:

1. A contact electrostatic printing apparatus comprising:

(a) an image bearing article comprising a developed image, wherein said developed image comprises a primary latent image and a secondary latent image, wherein said image bearing article comprises:

(i) a substrate; and (ii) at least one conformable layer over the substrate having reduced absorption of liquid toner carrier fluid; and (b) an image separator comprising the secondary latent image, wherein the conformable layer is comprised of materials selected from the group consisting of a silicone elastomer having a cross-linking density achieved from use of at least 30 pph of a cross-linking agent, a silicone elastomer containing phenyl end-groups, a mixture of methylsilicone elastomer, a fluorosilicone elastomer and a fluoroelastomer, and a silicone elastomer containing silicon oxide filler.

2. The contact electrostatic printing apparatus according to claim 1, wherein the at least one conformable layer over the substrate is comprised of the silicone elastomer having a cross-linking density achieved from use of at least 30 pph of a cross-linking agent.

3. The contact electrostatic printing apparatus of claim 2, wherein the silicone elastomer has a cross-linking density achieved from use of from 30 pph to 60 pph of a cross-linking agent.

4. The contact electrostatic printing apparatus according to claim 1, wherein the at least one conformable layer over the substrate is comprised of the silicone elastomer containing phenyl end-groups.

5. The contact electrostatic printing apparatus according to claim 1, wherein the at least one conformable layer over the substrate is comprised of the mixture of a methylsilicone elastomer, a fluorosilicone elastomer and a fluoroelastomer.

6. The contact electrostatic printing apparatus according to claim 1, wherein the at least one conformable layer over the substrate is comprised of the silicone elastomer containing a silicon oxide filler.

7. The contact electrostatic printing apparatus of claim 1, wherein only one conformable layer is present.

8. The contact electrostatic printing apparatus of claim 1, wherein more than one conformable layer is present.

* * * * *